US008152482B2

(12) United States Patent
Umemura et al.

(10) Patent No.: US 8,152,482 B2
(45) Date of Patent: Apr. 10, 2012

(54) DISPLACEMENT CONTROL VALVE FOR VARIABLE DISPLACEMENT COMPRESSOR

(75) Inventors: Satoshi Umemura, Kariya (JP); Tatsuya Hirose, Kariya (JP); Yuji Hashimoto, Kariya (JP); Norio Uemura, Tokyo (JP); Ryosuke Cho, Tokyo (JP); Keigo Shirafuji, Tokyo (JP)

(73) Assignees: Kabushiki Kaisha Toyota Jidoshokki, Aichi-Ken (JP); Eagle Industry Co., Ltd., Tokyo (JP)

( * ) Notice: Subject to any disclaimer, the term of this patent is extended or adjusted under 35 U.S.C. 154(b) by 773 days.

(21) Appl. No.: 12/256,890

(22) Filed: Oct. 23, 2008

(65) Prior Publication Data

US 2009/0108221 A1 Apr. 30, 2009

(30) Foreign Application Priority Data

Oct. 24, 2007 (JP) ..... 2007-276514

(51) Int. Cl.
*F04B 27/08* (2006.01)
*F04B 1/12* (2006.01)
*F25B 49/00* (2006.01)

(52) U.S. Cl. ..... 417/269; 417/222.2; 417/307; 417/26; 62/228.3

(58) Field of Classification Search ..... 417/222.2
See application file for complete search history.

(56) References Cited

U.S. PATENT DOCUMENTS

| | | | | |
|---|---|---|---|---|
| 6,514,049 | B2 * | 2/2003 | Kayukawa et al. | 417/222.2 |
| 6,684,654 | B2 * | 2/2004 | Fukasaku et al. | 62/228.3 |
| 6,772,990 | B2 | 8/2004 | Sasaki et al. | 251/129.03 |
| 2003/0145615 | A1 * | 8/2003 | Sasaki et al. | 62/228.3 |
| 2006/0086918 | A1 | 4/2006 | Koyama | 251/129.01 |
| 2006/0280616 | A1 | 12/2006 | Umemura et al. | 417/222.2 |

FOREIGN PATENT DOCUMENTS

| | | |
|---|---|---|
| JP | 2006-342718 | 12/2006 |
| JP | 2007-64028 | 3/2007 |

* cited by examiner

*Primary Examiner* — Sikha Roy
(74) *Attorney, Agent, or Firm* — Locke Lord LLP

(57) ABSTRACT

A displacement control valve for a variable displacement compressor. The displacement control valve includes a drive force transmission body, a pressure sensitive chamber, an internal passage, and a valve body. The valve body includes an annular seal which is contactable with a valve seat surface facing toward the first valve body. The drive force transmission body includes a drive rod and a valve body structure having a shaft passage and forming the first valve body. The drive rod is fitted to the shaft passage and coupled to the valve body structure so as to form a gap passage between an outer surface of the drive rod and a wall surface of the shaft passage. The internal passage includes a recess arranged radially inward from the annular seal, the shaft passage, and the gap passage. The gap passage is in direct communication with the recess.

5 Claims, 7 Drawing Sheets

DISPLACEMENT CONTROL VALVE FOR VARIABLE DISPLACEMENT COMPRESSOR

BACKGROUND OF THE INVENTION

The present invention relates to a displacement control valve for a variable displacement compressor that adjusts the pressure in a control pressure chamber by supplying refrigerant from a discharge pressure region to the control pressure chamber and releases refrigerant from the control pressure chamber to a suction pressure region so as to control the compressor displacement in accordance with the pressure adjustment of the control pressure chamber.

In a variable displacement compressor that includes a control pressure chamber accommodating a swash plate with a variable inclination angle, the inclination angle of the swash plate decreases as the pressure of a control pressure chamber becomes high and increases as the pressure of the control pressure chamber becomes low. When the inclination angle of the swash plate becomes small, the stroke of a piston becomes small and the displacement of the compressor decreases. When the inclination angle of the swash plate becomes large, the stroke of a piston becomes large and the compressor displacement increases. Japanese Laid-Open Patent Publication No. 2006-342718 describes a displacement control valve for controlling the flow rate of refrigerant supplied to a control pressure chamber from a discharge pressure region through a supply passage and the flow rate of refrigerant released from the control pressure chamber into a suction pressure region through a release passage to adjust the pressure of the control pressure chamber.

If the variable displacement compressor is not operated for a long period of time, refrigerant liquefies and collects in the control pressure chamber. When the variable displacement compressor is activated in a state in which liquefied refrigerant is collected in the control pressure chamber, if the displacement control valve keep the cross-sectional area of the regulation passage in a small state, the liquefied refrigerant cannot be readily released from the control pressure chamber to the suction pressure region through the regulation passage. This may increase the pressure of the control pressure chamber to an excessively high level due to vaporization of the liquefied refrigerant in the control pressure chamber. Thus, too much time would be required for the variable displacement compressor to increase displacement after activation.

The displacement control valve described in the above publication includes a bellows, an electromagnetic solenoid, and a valve body driven by the electromagnetic solenoid. The valve body is connected to a drive rod of the electromagnetic solenoid. A connection portion is connected to the valve body, and an engagement portion, which is contactable with the connection portion, is connected to the bellows. A relief passage extending to a suction chamber (suction pressure region) is formed in the valve body. The pressure (suction pressure) in the relief passage acts on the engagement part joined to the bellows. A displacement chamber formed outside the bellows is in communication with the control pressure chamber and is communicable with a discharge chamber (discharge pressure region) through a valve hole in the valve body. A valve portion opens and closes the valve hole.

When the variable displacement compressor is activated in a state in which liquefied refrigerant is collected in the control pressure chamber, the liquefied refrigerant flows into the displacement chamber. This contracts the bellows and moves the engagement portion, which is connected to the bellows, away from the connection portion. This enables the liquefied refrigerant in the control pressure chamber to be released into the suction pressure region and thereby shortens the time required for the compressor displacement to increase after activation of the variable displacement compressor.

The relief passage, which is for releasing refrigerant from the control pressure chamber into the suction pressure region, includes a terminal portion, which extends perpendicular to a linear shaft passage extending through the drive rod along the axis of the drive rod and opens in an outer surface of the drive rod. The terminal portion of the relief passage is a linear passage. Accordingly, the structure in which the linear shaft passage and the linear terminal portion extend perpendicular to each other in the drive rod increases the flow resistance. This is not preferable for readily releasing the liquefied refrigerant.

SUMMARY OF THE INVENTION

It is an object of the present invention to provide a displacement control valve that shortens the time required for the compressor displacement to increase immediately after activation of the variable displacement compressor.

To achieve the above object, one aspect of the present invention is to provide a displacement control valve for a variable displacement compressor for adjusting pressure of a control pressure chamber by supplying refrigerant from a discharge pressure region to the control pressure chamber and releasing refrigerant from the control pressure chamber to a suction pressure region so as to control compressor displacement. The displacement control valve includes an electromagnetic solenoid, a drive force transmission body, a pressure sensitive chamber, a pressure sensitive unit, an internal passage, a first valve body, a second valve body, a third valve body. The drive force transmission body is driven by the electromagnetic solenoid. The pressure sensitive chamber is in communication with the control pressure chamber. The pressure sensitive unit includes a pressure sensitive body arranged in the pressure sensitive chamber. The internal passage arranged in the drive force transmission body is communicable with the pressure sensitive chamber. The first valve body is arranged in the drive force transmission body to adjust the cross-sectional area of a passage between the suction pressure region and the internal passage. The second valve body is contacted with and separated from the pressure sensitive body and arranged in the drive force transmission body to adjust the cross-sectional area of a passage between the internal passage and the pressure sensitive chamber. The third valve body is arranged in the drive force transmission body to adjust the cross-sectional area of a passage between the pressure sensitive chamber and the discharge pressure region. The first valve body includes an annular seal which is contactable with a valve seat surface facing toward the first valve body. The drive force transmission body includes a drive rod and a valve body structure having a shaft passage and forming the first valve body. The drive rod is fitted to the shaft passage and coupled to the valve body structure so as to form a gap passage between an outer surface of the drive rod and a wall surface of the shaft passage. The internal passage includes a recess arranged radially inward from the annular seal, the shaft passage, and the gap passage. The gap passage is in direct communication with the recess.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of a clutchless-type variable displacement compressor according to the present invention will now be discussed with reference to FIGS. 1 to 5.

Figure 1:
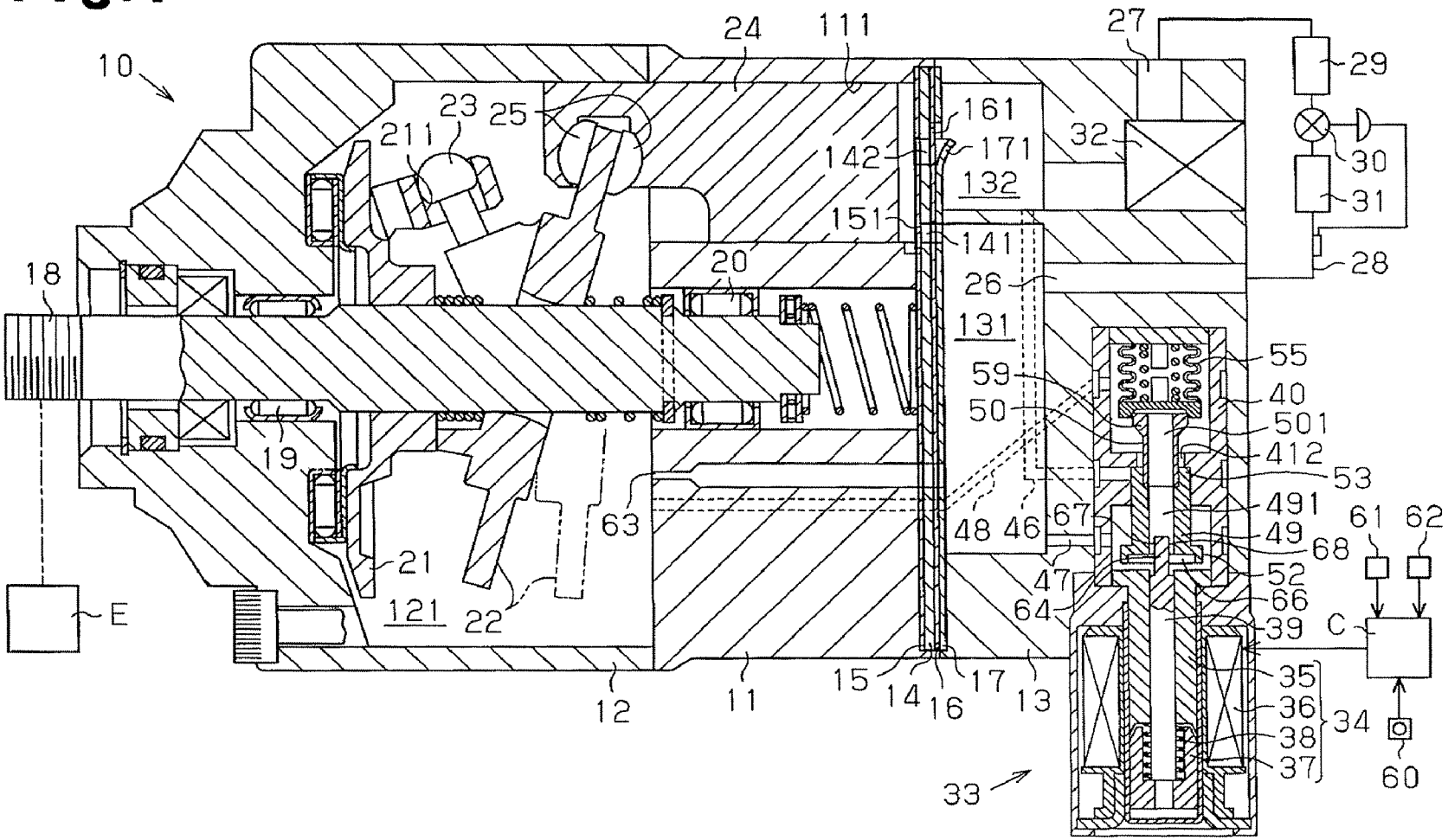
FIG. 1 is a cross-sectional view showing a first embodiment of a variable displacement compressor according to the present invention.

As shown in FIG. 1, the housing of a variable displacement compressor 10 includes a cylinder block 11, a front housing member 12, and a rear housing member 13. The front housing member 12 is secured to the front end of the cylinder block 11, and the rear housing member 13 is secured to the rear end of the cylinder block 11 with a valve plate 14, valve flap plates 15 and 16, and a retainer plate 17 arranged in between. The cylinder block 11, the front housing member 12, and the rear housing member 13 form the housing of the compressor 10.

The front housing member 12 and the cylinder block 11 define a control pressure chamber 121. The front housing member 12 and the cylinder block 11 rotatably support a rotary shaft 18 with radial bearings 19 and 20. The rotary shaft 18, which protrudes out of the control pressure chamber 121, is driven by a vehicle engine E, which functions as an external power source.

A rotary support 21 is fixed to the rotary shaft 18, and a swash plate 22 is supported on the rotary shaft 18. The swash plate 22 is supported to be movable in the axial direction of the rotary shaft 18 and inclinable relative to the rotary shaft 18. The rotary support 21 includes guide holes 211. Guide pins 23 are formed on the swash plate 22. The guide pins 23 are movably fitted into the guide holes 211. The engagement of the guide holes 211 with the guide pins 23 allows the swash plate 22 to incline as it moves along the axial direction of the rotary shaft 18 and rotate integrally with the rotary shaft 18. The swash plate 22 is inclined by moving the guide pins 23 relative to the guide holes 211 while allowing the swash plate 22 to move along the rotary shaft 18.

When a radially central portion of the swash plate 22 moves toward the rotary support 21, the inclination of the swash plate 22 increases. The maximum inclination angle of the swash plate 22 is restricted by contact between the rotary support 21 and the swash plate 22. In the state shown by solid lines in FIG. 1, the swash plate 22 is located at a maximum inclination position. In a state shown by the broken lines, the swash plate 22 is located at the minimum inclination position. The minimum inclination is set at a value slightly greater than 0 degree.

Cylinder bores 111 (only one shown) extend through the cylinder block 11. Each cylinder bore 111 accommodates a piston 24. Shoes 25 convert rotation of the swash plate 22 to reciprocation of the pistons 24. Thus, each piston 24 reciprocates in the corresponding cylinder bore 111.

A suction chamber 131 and a discharge chamber 132 are defined in the rear housing member 13. The control pressure chamber 121 is connected to the suction chamber 131 through a pressure release passage 63. Suction ports 141 extend through the valve plate 14, the valve flap plate 16, and the retainer plate 17 in correspondence with the cylinder bores 111. Further, discharge ports 142 extend through the valve plate 14 and the valve flap plate 15 in correspondence with the cylinder bores 111. Suction valve flaps 151 are formed in the valve flap plate 15 in correspondence with the suction ports 141, and discharge valve flaps 161 are formed in the valve flap plate 16 in correspondence with the discharge ports 142. As each piston 24 moves from the top dead center to the bottom dead center (from the right side to the left side as viewed in FIG. 1), refrigerant is drawn from the suction chamber 131 into the associated cylinder bore 111 through the corresponding suction port 141 while flexing the suction valve flap 151. When each piston 24 moves from the bottom dead center to the top dead center (from the left side to the right side as viewed in FIG. 1), gaseous refrigerant is discharged out of the associated cylinder bore 111 into the discharge chamber 132, which serves as a discharge pressure region, through the corresponding discharge port 142 while flexing the discharge valve flap 161. The opening of the discharge valve flap 161 is restricted by abutment against a retainer 171 on the retainer plate 17.

A suction passage 26, which is for drawing refrigerant into the suction chamber 131, and a discharge passage 27, which is for discharging refrigerant out of the discharge chamber 132, are connected to each other by an external refrigerant circuit 28. The external refrigerant circuit 28 includes a heat exchanger 29 for receiving heat from the refrigerant, an expansion valve 30, and a heat exchanger 31 for transferring ambient heat to the refrigerant. The expansion valve 30 controls the flow rate of the refrigerant in accordance with changes in gas temperature at the outlet of the heat exchanger 31.

A check valve 32 is arranged on the discharge passage 27. When the check valve 32 is open, refrigerant flows out of the discharge chamber 132 into the external refrigerant circuit 28. When the check valve 32 is closed, refrigerant cannot flow out of the discharge chamber 132 into the external refrigerant circuit 28.

An electromagnetic displacement control valve 33 is arranged in the rear housing member 13.

Figure 2:
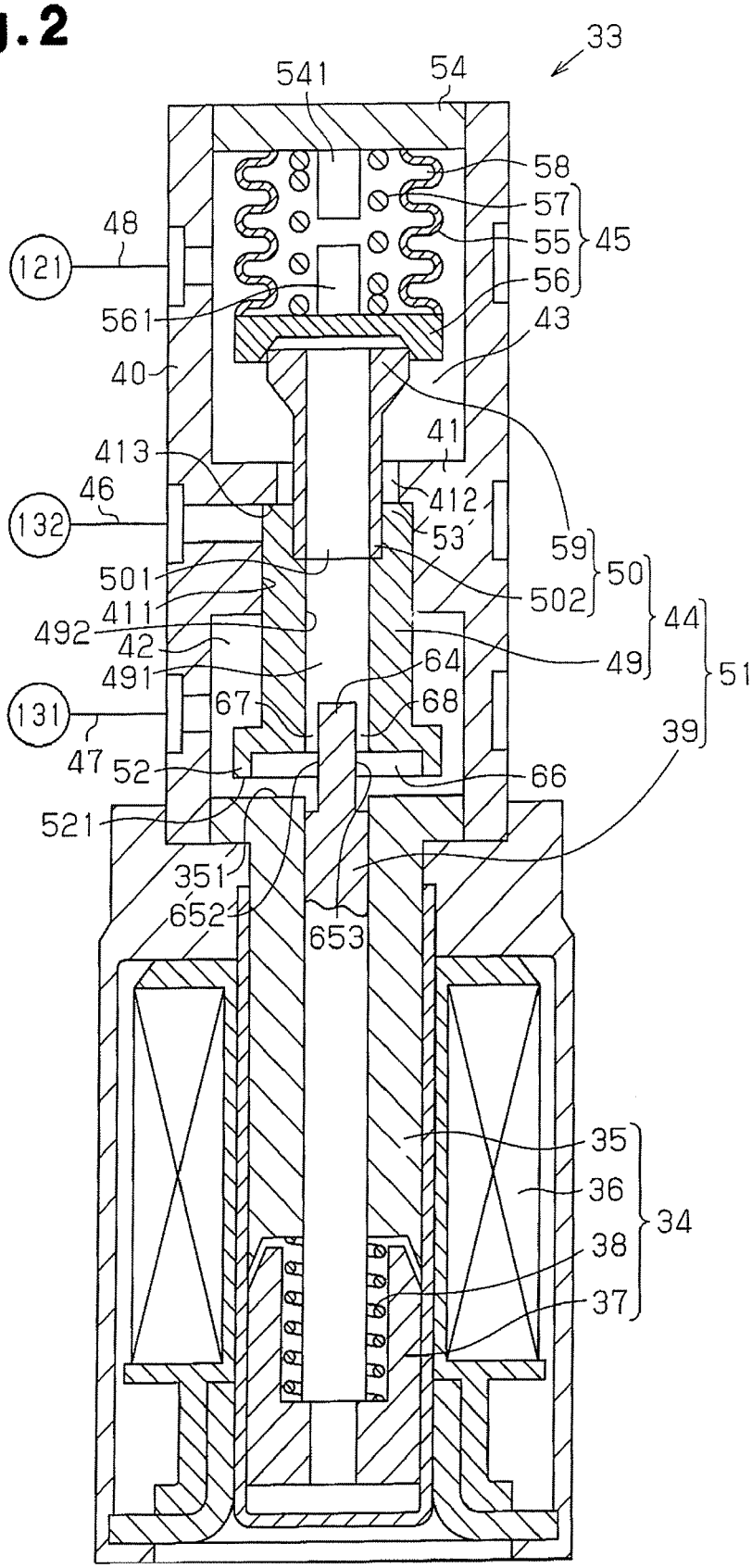
FIG. 2 is a cross-sectional view of a displacement control valve shown in FIG. 1.

As shown in FIG. 2, the displacement control valve 33 includes an electromagnetic solenoid 34 having a fixed steel core 35, a coil 36, and a movable steel core 37. When the coil 36 is supplied with current, the fixed steel core 35 is excited. This attracts the movable steel core 37 toward the fixed steel core 35. A biasing spring 38 is arranged between the fixed steel core 35 and the movable steel core 37. The spring force of the biasing spring 38 biases the movable steel core 37 away from the fixed steel core 35. A control computer C, which is shown in FIG. 1, controls the supply of current to the electromagnetic solenoid 34. In this embodiment, the control computer C executes duty ratio control on the electromagnetic solenoid 34. A drive rod 39 is fixed to the movable steel core 37.

A partition wall 41 is formed integrally with a cylindrical valve housing 40 of the displacement control valve 33. The partition wall 41 partitions the interior of the valve housing 40 into a valve accommodation chamber 42 and a pressure sensitive chamber 43. The drive rod 39 includes a distal portion that defines a fitting portion 64 extending into the valve accommodation chamber 42. A lid 54, which is fixed to the valve housing 40, closes the pressure sensitive chamber 43. A valve assembly 44 is arranged in the valve accommodation chamber 42 in a state coupled to the drive rod 39. A pressure sensitive mechanism 45 is arranged in the pressure sensitive chamber 43. The valve accommodation chamber 42 is in communication with the suction chamber 131 through a passage 47. The pressure sensitive chamber 43 is in communication with the control pressure chamber 121 through a passage 48.

The partition wall 41 includes an insertion hole 411, which extends from the valve accommodation chamber 42 towards the pressure sensitive chamber 43, and a valve hole 412, which extends from the pressure sensitive chamber 43 towards the valve accommodation chamber 42. The insertion hole 411 and the valve hole 412 are in communication with each other. The insertion hole 411 and the valve hole 412 each have a circular cross-section.

The valve hole 412 is in communication with the pressure sensitive chamber 43, and the insertion hole 411 is communicable to the discharge chamber 132 through a passage 46. The valve assembly 44 includes a main valve body structure 49, which is fitted into the insertion hole 411, and a cylindrical sub-valve body structure 50, which is fitted into and fixed to the main valve body structure 49 in the insertion hole 411.

A shaft passage 491 extends through the main valve body structure 49 along a moving direction of the drive rod 39. A recess 66 is formed in the lower end of the main valve body structure 49 in communication with the shaft passage 491. The shaft passage 491 is defined by a cylindrical wall surface 492. The fitting portion 64 of the drive rod 39 is press-fitted and fixed to the shaft passage 491. A shaft passage 501 extends through the sub-valve body structure 50 along the moving direction of the drive rod 39 in communication with the shaft passage 491. The shaft passage 501 is communicable with the pressure sensitive chamber 43.

Figure 3A:
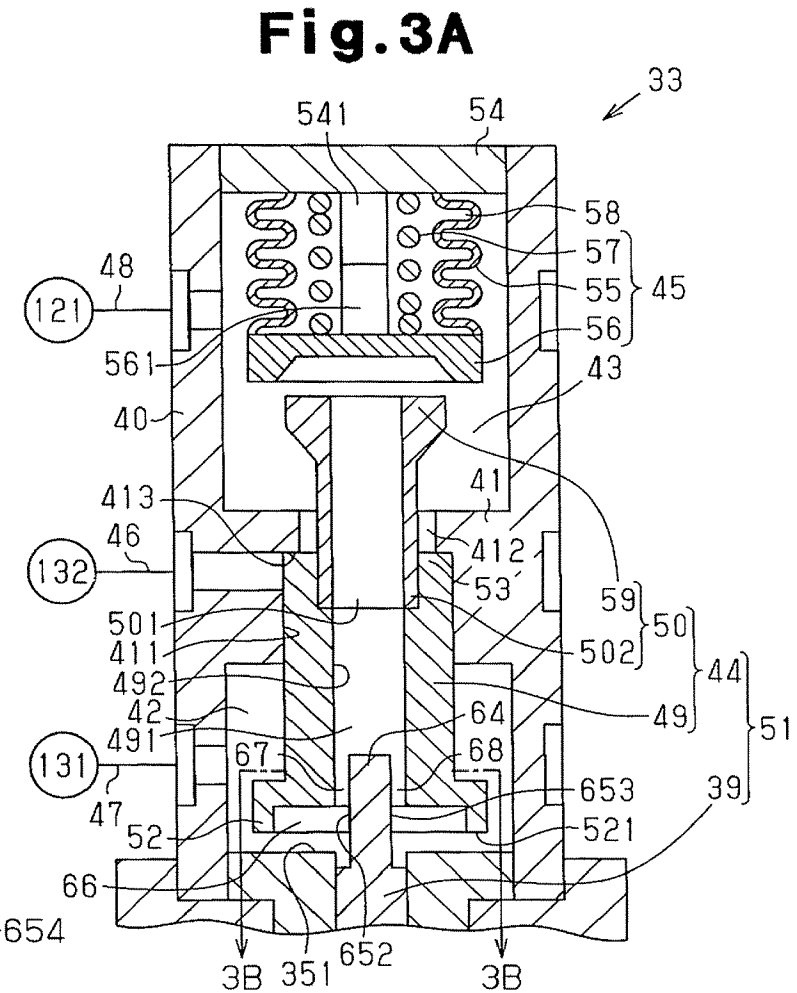
FIG. 3A is a partial cross-sectional view of the displacement control valve shown in FIG. 2.
Figure 3B:
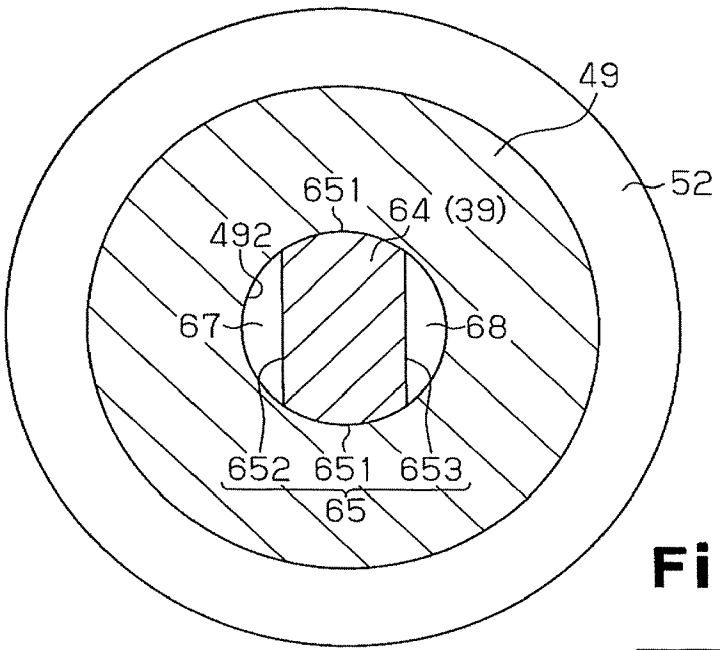
FIG. 3B is a cross-sectional view taken along line 3B-3B in FIG. 3A.
Figure 3C:
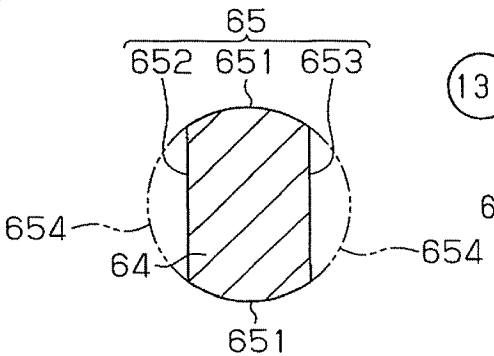
FIG. 3C is a partially enlarged view of FIG. 3B.

As shown in FIG. 3B, the fitting portion 64 of the drive rod 39 has an outer surface 65 including two circumferential surfaces 651 and two flat surfaces 652 and 653. The two circumferential surfaces 651 are concentric. As shown in FIG. 3C, the flat surfaces 652 and 653 are located inward from a hypothetical circumferential surface 654, parts of which are formed by the circumferential surfaces 651. The circumferential surfaces 651 are in contact with the cylindrical wall surface 492. Two gap passages 67 and 68 are formed between the cylindrical wall surface 492 and the flat surfaces 652 and 653. The gap passages 67 and 68 are in communication with the shaft passage 491 and in directly communication with the recess 66.

The drive rod 39 and the valve assembly 44 form a drive force transmission body 51 driven by the electromagnetic force of the electromagnetic solenoid 34. The drive force transmission body 51 is driven in a direction (driving direction of drive force transmission body 51) directed from the valve accommodation chamber 42 towards the pressure sensitive chamber 43. The shaft passages 501 and 491, the gap passages 67 and 68, and the recess 66 form an internal passage in the drive force transmission body 51 that is communicable with the pressure sensitive chamber 43.

The main valve body structure 49 has an end (annular wall closing the recess 66) located in the valve accommodation chamber 42 and defining a first valve body 52. The first valve body 52 is contactable with a valve seat surface 351 formed on the fixed steel core 35. The lower surface of the first valve body 52 forms an annular seal 521, which is contactable with the valve seat surface 351. The recess 66 is located radially inward from the seal 521. The seal 521 of the first valve body 52 is located at an open position when separated from the valve seat surface 351. In such a state, the recess 66 and the valve accommodation chamber 42 are in communication. The seal 521 of the first valve body 52 is located at a closed position when in contact with the valve seat surface 351. In such a state, the recess 66 and the valve accommodation chamber 42 are disconnected. That is, the first valve body 52 is arranged in the drive force transmission body 51 so as to adjust the cross-sectional area of the passage between the valve accommodation chamber 42, which leads to the suction chamber 131, and the internal passage.

Further, the main valve body structure 49 has another end located in the insertion hole 411 and defining a third valve body 53. The third valve body 53 is contactable with a valve seat surface 413 formed on an opposing wall in the insertion hole 411. The third valve body 53 is located at an open position when separated from the valve seat surface 413. In such a state, the passage 46 leading to the discharge chamber 132 is in communication with the valve hole 412. The third valve body 53 is located at a closed position when in contact with the valve seat surface 413. In such a state, the passage 46 and the valve hole 412 are disconnected. That is, the third valve body 53 is arranged in the drive force transmission body 51 so as to adjust the cross-sectional area of the passage between the passage 46, which leads to the discharge chamber 132, and the valve hole 412. The passage 46, the insertion hole 411, the valve hole 412, the pressure sensitive chamber 43, and the passage 48 form a supply passage for supplying the refrigerant in the discharge chamber 132 to the control pressure chamber 121.

The pressure sensitive mechanism 45 includes a bellows 55, a plate-shaped pressure receiving body 56 joined with the bellows 55, and a biasing spring 57 for biasing the bellows 55 in a direction that expands the bellows 55. A vacuum chamber 58 is enclosed in the bellows 55 so that the pressure (suction pressure) in the shaft passages 501 and 491 acts in a direction that contracts the bellows 55. A stopper 541, which is arranged on the lid 54, and a stopper 561, which is arranged on the pressure receiving body 56, are contactable with each other. The stoppers 541 and 561 cooperate to determine the shortest length of the expandable bellows 55.

The pressure sensitive mechanism 45, the pressure sensitive chamber 43, and the vacuum chamber 58 form a pressure sensitive unit including the pressure receiving body 56. The position of the pressure receiving body 56 in the moving direction of the drive force transmission body 51 is restricted in accordance with the pressure (suction pressure) of the shaft passages 501 and 491. The bellows 55 and the pressure receiving body 56 form a pressure sensitive body biased in the driving direction of the drive force transmission body 51 by the pressure of the pressure sensitive chamber 43.

The sub-valve body structure 50 includes a small diameter portion 502 fitted into the shaft passage 491 of the main valve body structure 49 and a large diameter portion 59 having a larger diameter than the small diameter portion 502. The large diameter portion 59 defines a second valve body 59 that is contactable with the pressure receiving body 56. The second valve body 59 is arranged in the drive force transmission body 51 so as to adjust the cross-sectional area of the passage between the internal passage and the pressure sensitive chamber 43. The passage 48, the pressure sensitive chamber 43, the shaft passages 501 and 491, the gap passages 67 and 68, the recess 66, the valve accommodation chamber 42, and the passage 47 form a relief passage for releasing the refrigerant in the control pressure chamber 121 into the suction chamber 131.

The control computer C shown in FIG. 1 allows or stops the supply of current to the electromagnetic solenoid 34 in accordance with the activation or deactivation of an air conditioner operation switch 60. The control computer C is electrically connected to a room temperature setter 61 and a room temperature detector 62. When the air conditioner operation switch 60 is activated, the control computer C controls the supply of current to the electromagnetic solenoid 34 based on a temperature difference between a target room temperature, which is set in a vehicle with the room temperature setter 61, and a detected room temperature, which is detected by the room temperature detector 62.

Figure 4:
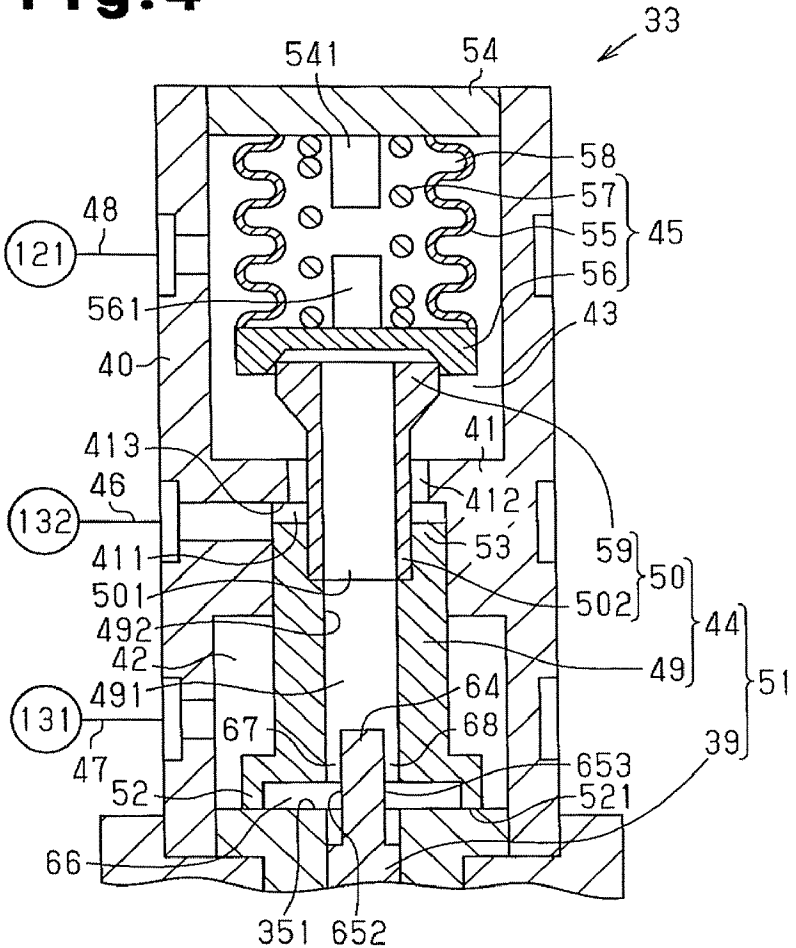
FIG. 4 is a partial cross-sectional view of the displacement control valve shown in FIG. 2.

When a vehicle engine E is running and the variable displacement compressor 10 is operated in a minimum displacement state, that is, a state in which the supply of current to the electromagnetic solenoid 34 is stopped (duty ratio is zero), as shown in FIG. 4, the first valve body 52 is located at the closed position in contact with the valve seat surface 351 due to the spring force of the biasing spring 57. Further, the third valve body 53 is located at the open position separated from the valve seat surface 413. In a state in which the drive force transmission body 51 is arranged at a first position where the first valve body 52 is located at the closed position and the third valve body 53 is located at the open position, the refrigerant in the discharge chamber 132 is sent to the control pressure chamber 121 so that the inclination angle of the swash plate 22 becomes minimum, as shown by the broken lines in FIG. 1. When the inclination angle of the swash plate becomes minimum, the discharge pressure in the discharge chamber 132 becomes low. This closes the check valve 32 and stops refrigerant circulation in the external refrigerant circuit 28. When refrigerant circulation is stopped, an air conditioning operation is also stopped.

The duty ratio is controlled to be 100% when the air conditioner operation switch 60 is activated to activate the variable displacement compressor 10. Such a control state continues for a predetermined time (e.g., few minutes) from the activation of the variable displacement compressor 10.

When the duty ratio is controlled to be 100%, the third valve body 53 is arranged at the closed position in contact with the valve seat surface 413 against the spring force of the biasing spring 57. Further, the first valve body 52 is arranged at the open position separated from the valve seat surface 351, as shown in FIG. 2. Therefore, the refrigerant in the discharge chamber 132 does not flow into the control pressure chamber 121.

If a state in which the variable displacement compressor 10 is not operated for a long time, liquefied refrigerant may collect in the control pressure chamber 121. Thus, if the liquefied refrigerant collected in the control pressure chamber 121 flows into the pressure sensitive chamber 43 such that the pressure sensitive chamber 43 becomes filled with the liquefied refrigerant, the bellows 55 would be contracted against the spring force of the biasing spring 57 by the liquid pressure in the pressure sensitive chamber 43. As a result, the pressure receiving body 56 is separated from the second valve body 59 as shown in the state of FIG. 3A, and the liquefied refrigerant in the control pressure chamber 121 is released into the suction chamber 131 through the pressure sensitive chamber 43, the shaft passages 501 and 491, the gap passages 67 and 68, the recess 66, the valve accommodation chamber 42, and the passage 47. Further, the refrigerant in the discharge chamber 132 does not flow into the control pressure chamber 121. Thus, the pressure (control pressure) in the control pressure chamber 121 decreases and shifts the inclination angle of the swash plate 22 from the minimum to maximum. In this manner, the recovery operation for shifting the inclination angle of the swash plate 22 from minimum to maximum after activation is not inhibited by the presence of the liquefied refrigerant, and the inclination angle of the swash plate 22 readily shifts from minimum to maximum.

If the inclination angle of the swash plate 22 increases from the minimum inclination angle, the discharge pressure increases and the pressure at the upstream side of the check valve 32 in the discharge passage 27 rises. Therefore, when the inclination angle of the swash plate 22 is greater than the minimum inclination angle, the check valve 32 opens and the refrigerant in the discharge chamber 132 flows into the external refrigerant circuit 28. That is, refrigerant is circulated in the external refrigerant circuit 28, and an air conditioning operation is performed.

Figure 5:
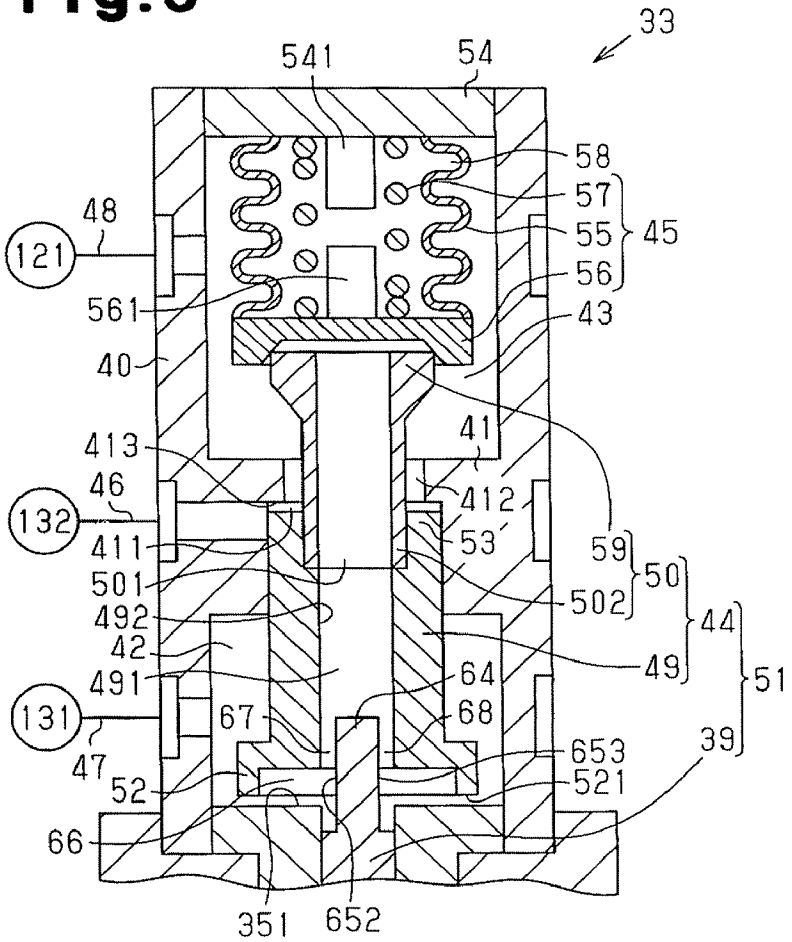
FIG. 5 is a partial cross-sectional view of the displacement control valve shown in FIG. 2.

When a predetermined time elapses during which the duty ratio is controlled to be 100%, the duty ratio control (variable displacement control) is then performed based on the temperature difference between the target room temperature and the detected room temperature. FIG. 5 shows one example of a state satisfying 0<(duty ratio)<100%. In this state, the first valve body 52 is arranged at the open position separated from the valve seat surface 351, and the third valve body 53 is arranged at the open position separated from the valve seat surface 413. In a state in which the drive force transmission body 51 is arranged at a second position where the first valve body 52 and the third valve body 53 are both located at the open positions, the refrigerant of the discharge chamber 132 is sent to the control pressure chamber 121 through the valve hole 412, the pressure sensitive chamber 43, and the passage 48. The refrigerant in the control pressure chamber 121 flows into the suction chamber 131 through the pressure release passage 63, and the pressure (suction pressure) of the suction chamber 131 is communicated to the valve accommodation chamber 42.

The pressure (suction pressure) of the suction chamber 131 communicated to the valve accommodation chamber 42 biases the valve assembly 44 so as to move the third valve body 53 toward the valve seat surface 413. As the suction pressure rises, the third valve body 53 approaches the valve seat surface 413, the flow rate of refrigerant from the discharge chamber 132 to the control pressure chamber 121 decreases, and the control pressure in the control pressure chamber 121 is lowered. This increases the inclination angle of the swash plate 22, increases the compressor displacement, and lowers the suction pressure. The lowered suction pressure moves the third valve body 53 away from the valve seat surface 413, increases the flow rate of the refrigerant from the discharge chamber 132 to the control pressure chamber 121, and raises the control pressure of the control pressure chamber 121. This decreases the inclination angle of the swash plate 22, reduces the compressor displacement, and increases the suction pressure. The suction pressure is controlled to be equalized with a set suction pressure set by the duty ratio for the electromagnetic solenoid 34.

The first embodiment has the advantages described below.

(1) When the first valve body 52 is located at the open position, the refrigerant of the control pressure chamber 121 flows into the suction chamber 131 through the shaft passages 491 and 501 in accordance with the internal pressure of the pressure sensitive chamber 43. The refrigerant flowing from the control pressure chamber 121 to the suction chamber 131 through the shaft passages 491 and 501 flows into the recess 66 from the gap passages 67 and 68 along the flat surfaces 652 and 653. The annular recess 66 surrounding the fitting portion 64 enlarges the cross-sectional area of the passage extending from the shaft passage 491 to the suction chamber 131. Further, the gap passages 67 and 68 and the recess 66 are in direct communication. That is, the two gap passages 67 and 68 and the recess 66 reduce the flow resistance in the passage extending from the shaft passage 491 to the suction chamber 131. Thus, the liquefied refrigerant in the control pressure chamber 121 is readily discharged to the suction chamber 131, and the inclination angle of the swash plate 22 is readily shifted from the minimum inclination angle to the maximum inclination angle after activation.

(2) The gap passages 67, 68 are formed by press-fitting the fitting portion 64, which forms part of the drive rod 39, to the shaft passage 491. The coupling structure in which the drive rod 39 is press-fitted to the shaft passage 491 to form the gap passages 67 and 68 is simple and convenient.

(3) The gap passages 67 and 68 are formed by forming the flat surfaces 652 and 653 in the outer surface 65 of the fitting portion 64. The structure in which the flat surfaces 652 and 653 are formed on the outer surface 65 to obtain the gap passages 67 and 68 is simple and convenient. Further, the formation of the flat surfaces 652 and 653 is convenient.

(4) There is a strong demand for miniaturization of the displacement control valve 33 used in the variable displacement compressor 10, which is installed in vehicles. Thus, reduction in the diameter of the drive rod 39 is required. It is therefore desirable that the circumferential length of the circumferential surfaces 651 in the fitting portion 64 be maximized to reinforce the coupling of the drive rod 39, the diameter of which cannot be increased, and the main valve body structure 49. Further, to reduce the flow resistance in the passage extending from the shaft passage 491 to the suction chamber 131, it is desirable that the cross-sectional area of the gap passages 67 and 68 be maximized. The structure of using the two gap passages 67 and 68 is preferable for reinforcing the coupling of the drive rod 39 and the main valve body structure 49 while ensuring an optimal cross-sectional area in the gap passages.

A second embodiment will now be discussed with reference to FIGS. 6A and 6B. To avoid redundancy, like or same reference numerals are given to those components that are the same as the corresponding components of the first embodiment.

Figure 6A:
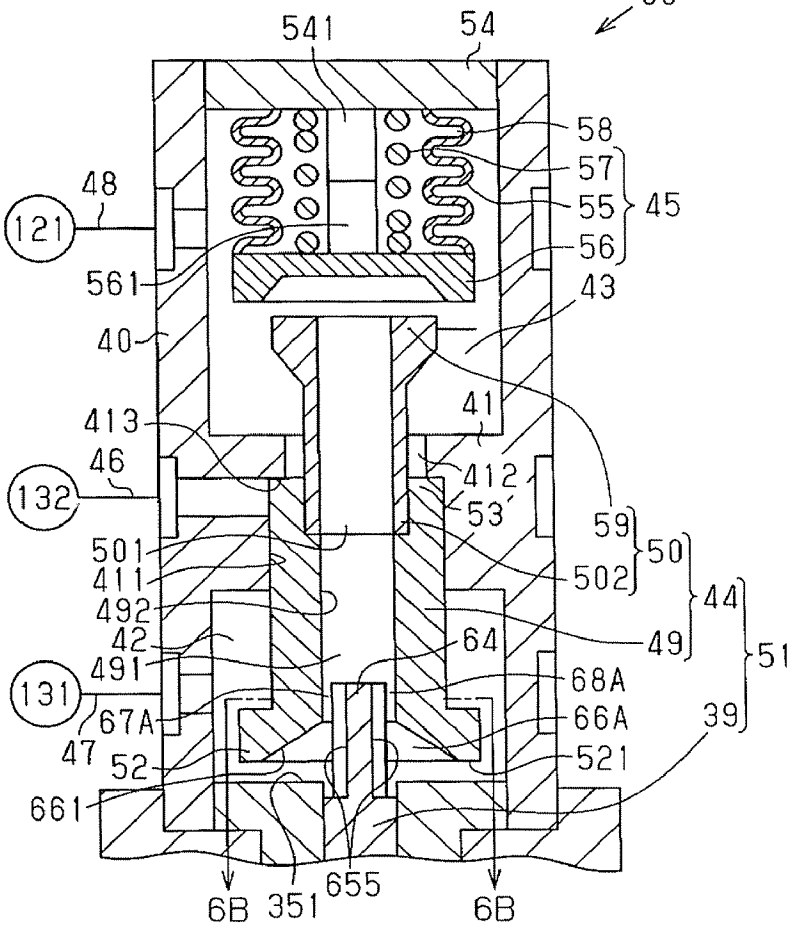
FIG. 6A is a partial cross-sectional view showing a second embodiment of a displacement control valve according to the present invention.

As shown in FIG. 6A, a wall surface 661 forming a recess 66A is a conical surface in which the diameter decreases from the drive rod 39 towards the main valve body structure 49.

Figure 6B:
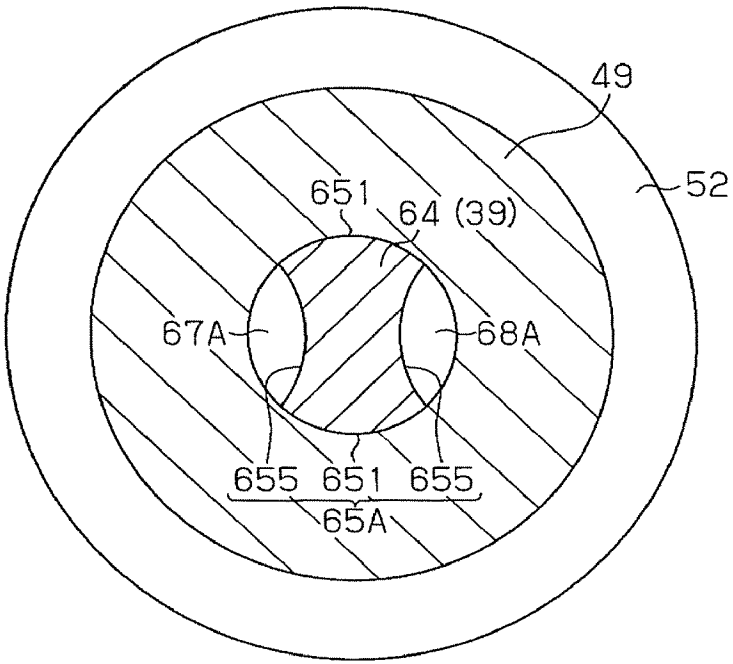
FIG. 6B is a cross-sectional view taken along line 6B-6B in FIG. 6A.

As shown in FIG. 6B, an outer surface 65A of the fitting portion 64 includes two circumferential surfaces 651 and two concave surfaces 655 (circumferential surface in this embodiment).

The conical wall surface 661 and the cylindrical wall surface 492 of the shaft passage 491 intersect at an obtuse angle. Thus, the conical wall surface 661 reduces the flow resistance in the passage extending from the shaft passage 491 to the suction chamber 131. The cross-sectional area at gap passages 67A and 68A between the circumferential surfaces 651 and the concave surfaces 655 is larger than the cross-sectional area of the gap passages 67 and 68 in the first embodiment. This reduces the flow resistance in the gap passages 67A and 68A. Further, the coupling of the drive rod 39 and the main valve body structure 49 is reinforced by the shapes of the concave surfaces 655.

Figure 7A:
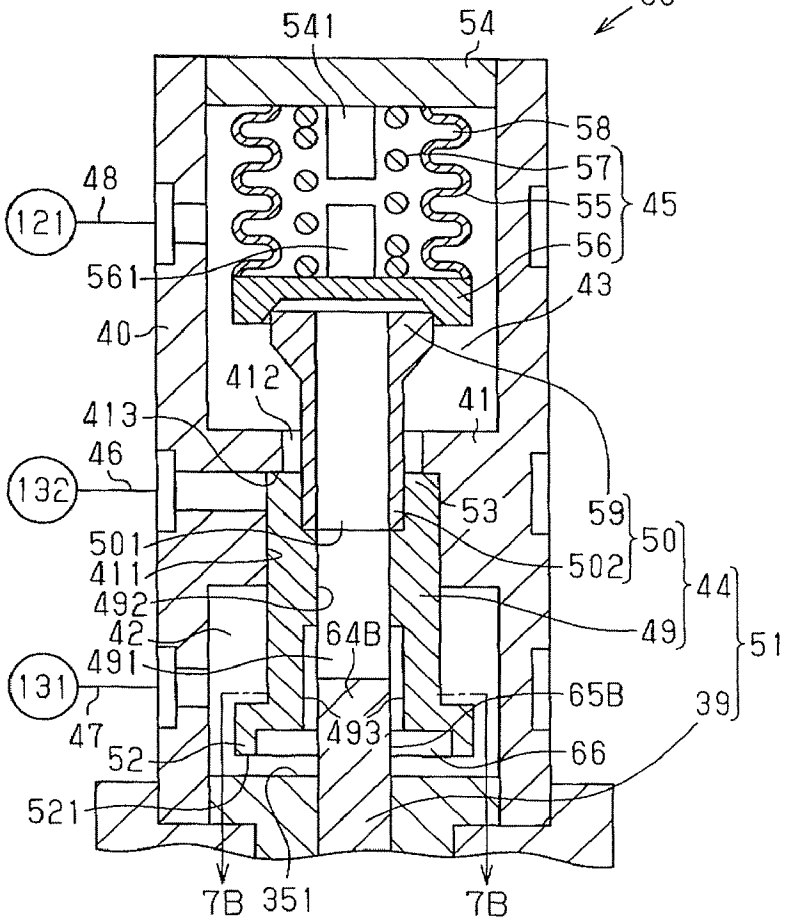
FIG. 7A is a partial-cross sectional view showing a third embodiment of a displacement control valve according to the present invention.

A third embodiment will now be described with reference to FIGS. 7A and 7B. To avoid redundancy, like or same reference numerals are given to those components that are the same as the corresponding components of the first embodiment.

Figure 7B:
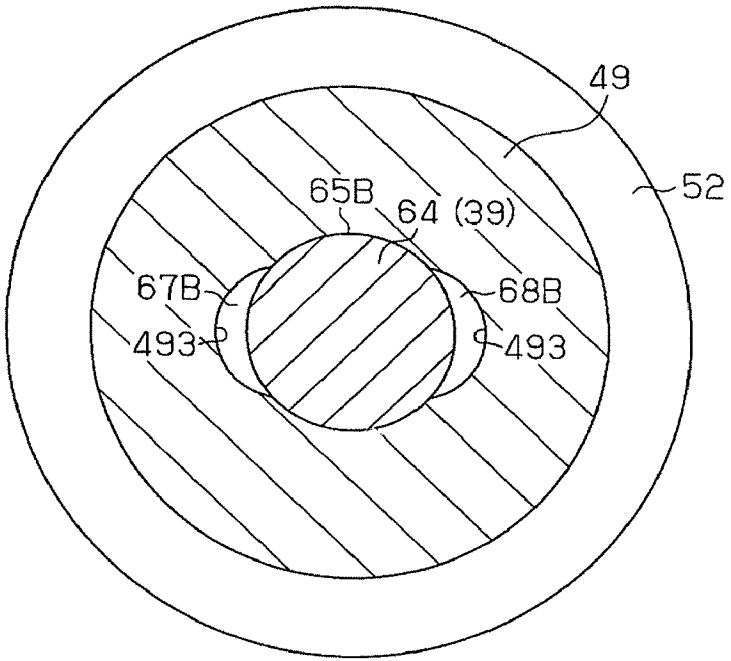
FIG. 7B is a cross-sectional view taken along line 7B-7B in FIG. 7A.

As shown in FIG. 7B, an outer surface 65B of a fitting portion 64B is a circumferential surface, and the cylindrical wall surface 492 forming the shaft passage 491 has a lower portion including two concave surfaces 493. The gap passages 67B and 68B are formed between the concave surface 493 and the outer surface 65B, and the gap passages 67B and 68B are in communication with the shaft passage 491 and the recess 66.

The third embodiment has advantages (1) and (2) of the first embodiment.

Figure 8A:
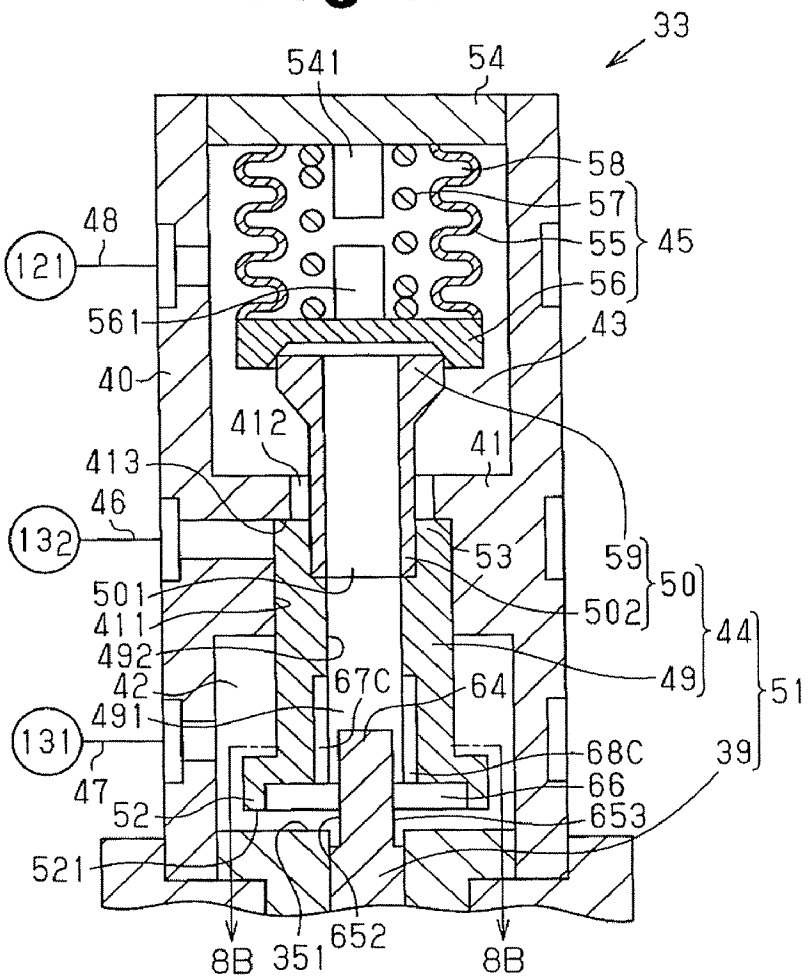
FIG. 8A is a partial-cross sectional view showing a fourth embodiment of a displacement control valve according to the present invention.
Figure 8B:
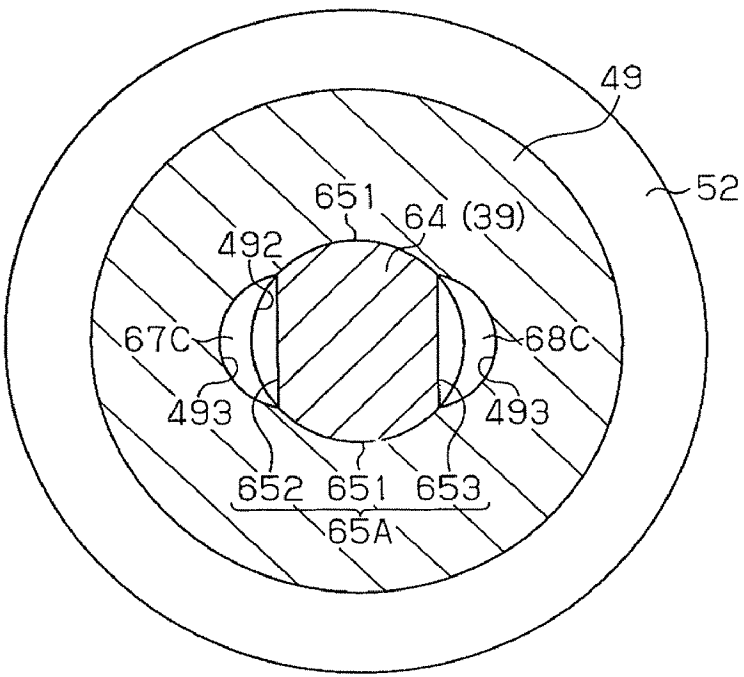
FIG. 8B is a cross-sectional view taken along line 8B-8B in FIG. 8A.

A fourth embodiment will now be described with reference to FIGS. 8A and 8B. To avoid redundancy, like or same reference numerals are given to those components that are the same as the corresponding components of the first and third embodiments.

Gap passages 67C and 68C in the fourth embodiment have the features of the gap passages 67 and 68 in the first embodiment and the features of the gap passages 67B and 68B in the third embodiment. The cross-sectional area of the gap passages 67C and 68C formed between the flat surfaces 652 and 653 and the concave surfaces 493 is greater than any of the cross-sectional areas of the gap passages in the first to the third embodiments.

It should be apparent to those skilled in the art that the present invention may be embodied in many other specific forms without departing from the spirit or scope of the invention. Particularly, it should be understood that the present invention may be embodied in the following forms.

The pressure sensitive unit may include a pressure sensitive body having a diaphragm.

A pressure sensitive unit using a piston type movable wall as the pressure sensitive body may be employed.

The present invention may be applied to a variable displacement compressor that receives drive force through a clutch.

The present examples and embodiments are to be considered as illustrative and not restrictive, and the invention is not to be limited to the details given herein, but may be modified within the scope and equivalence of the appended claims.

The invention claimed is:

1. A displacement control valve for a variable displacement compressor for adjusting pressure of a control pressure chamber by supplying refrigerant from a discharge pressure region to the control pressure chamber and releasing refrigerant from the control pressure chamber to a suction pressure region so as to control compressor displacement, the displacement control valve comprising:

an electromagnetic solenoid;

a drive force transmission body driven by the electromagnetic solenoid;

a pressure sensitive chamber which is in communication with the control pressure chamber;

a pressure sensitive unit including a pressure sensitive body arranged in the pressure sensitive chamber;

an internal passage arranged in the drive force transmission body which is communicable with the pressure sensitive chamber;

a first valve body arranged in the drive force transmission body to adjust the cross-sectional area of a passage between the suction pressure region and the internal passage;

a second valve body contacted with and separated from the pressure sensitive body and arranged in the drive force transmission body to adjust the cross-sectional area of a passage between the internal passage and the pressure sensitive chamber; and a third valve body arranged in the drive force transmission body to adjust the cross-sectional area of a passage between the pressure sensitive chamber and the discharge pressure region;

wherein the first valve body includes an annular seal which is contactable with a valve seat surface facing toward the first valve body;

the drive force transmission body includes a drive rod and a valve body structure having a shaft passage and forming the first valve body;

the drive rod is fitted to the shaft passage and coupled to the valve body structure so as to form a gap passage between an outer surface of the drive rod and a wall surface of the shaft passage;

the internal passage includes a recess arranged radially inward from the annular seal, the shaft passage, and the gap passage;

the gap passage is in direct communication with the recess;

the wall surface of the shaft passage includes a circumferential surface;

the outer surface of the drive rod includes a circumferential surface and a retracted surface located inward from a hypothetical circumferential surface having the same diameter as the circumferential surface; and the gap passage is formed between the wall surface of the shaft passage and the retracted surface.

2. The displacement control valve according to claim 1, wherein the drive rod is press-fitted to the shaft passage.

3. The displacement control valve according to claim 1, wherein the retracted surface is a flat surface.

4. The displacement control valve according to claim 1, wherein the gap passage is defined by a concave surface, which is formed in the wall surface of the shaft passage, and the outer surface of the drive rod.

5. The displacement control valve according to claim 1, wherein the gap passage includes two gap passages.

* * * * *